US010509361B2

(12) United States Patent
Wada et al.

(10) Patent No.: US 10,509,361 B2
(45) Date of Patent: Dec. 17, 2019

(54) IMAGE FORMING APPARATUS AND CARTRIDGE MOUNTABLE ON THE SAME

(71) Applicant: CANON KABUSHIKI KAISHA, Tokyo (JP)

(72) Inventors: Koji Wada, Yokohama (JP); Tachio Kawai, Tokyo (JP); Shota Kase, Kawasaki (JP); Terutaka Endo, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/201,169

(22) Filed: Nov. 27, 2018

(65) Prior Publication Data

US 2019/0163121 A1 May 30, 2019

(30) Foreign Application Priority Data

Nov. 30, 2017 (JP) ..... 2017-230514

(51) Int. Cl.
*G03G 21/16* (2006.01)
*G03G 21/18* (2006.01)
*G03G 15/20* (2006.01)

(52) U.S. Cl.
CPC ..... *G03G 21/1817* (2013.01); *G03G 15/2017* (2013.01); *G03G 21/1853* (2013.01)

(58) Field of Classification Search
CPC ..... G03G 21/1619; G03G 21/1633; G03G 21/1685; G03G 21/1817; G03G 21/1832; G03G 21/1842; G03G 21/1864; G03G 21/1871; G03G 2215/692; G03G 2221/1654
(Continued)

(56) References Cited

U.S. PATENT DOCUMENTS 7,532,841 B2 * 5/2009 Tanaka ..... G03G 21/1832 399/108
7,747,198 B2 * 6/2010 Nakagami ..... G03G 21/1832 399/258
(Continued)

FOREIGN PATENT DOCUMENTS

JP 2002366006 A 12/2002
JP 2012230297 A 11/2012
(Continued)

*Primary Examiner* — Hoan H Tran
(74) *Attorney, Agent, or Firm* — Canon USA, Inc., IP Division

(57) ABSTRACT

A cartridge detachably attachable to a main body of an image forming apparatus, the main body including: a fixing portion that includes a heating rotation member; and a mounting portion on which the cartridge is mounted, the fixing portion including a fixing shutter movable between a first position where a part of the heating rotation member is covered and a second position where the part of the heating rotation member is exposed, the fixing shutter including a force receiving portion that receives a force for causing the fixing shutter to move from the first position to the second position, the cartridge including a photosensitive member, a frame that supports the photosensitive member, and a pressing portion that presses the force receiving portion of the fixing shutter while the cartridge is being mounted on the mounting portion.

8 Claims, 9 Drawing Sheets

(58) Field of Classification Search
USPC ..... 399/107–111, 113, 114, 122, 320, 328, 399/329
See application file for complete search history.

(56) References Cited

U.S. PATENT DOCUMENTS 8,620,181 B2 * 12/2013 Murakami ..... G03G 21/1832 399/114
9,367,031 B2 * 6/2016 Wada ..... G03G 21/1814

FOREIGN PATENT DOCUMENTS

JP 2013-224987 A 10/2013
JP 2013224987 A 10/2013

* cited by examiner

IMAGE FORMING APPARATUS AND CARTRIDGE MOUNTABLE ON THE SAME

BACKGROUND

Field

The present disclosure relates to an electrophotographic image forming apparatus, such as an electrophotographic copying machine, an electrophotographic printer (a light-emitting diode (LED) printer, a laser beam printer, etc.), a facsimile apparatus, or a word processor, and a cartridge mountable on the image forming apparatus.

Description of the Related Art

Heretofore, a structure in which a cartridge is detachably attachable to a main body of an image forming apparatus so that a photosensitive member or the like can be replaced has been adopted in an electrophotographic image forming apparatus. The use of such a cartridge system enables a user himself/herself to perform maintenance of the image forming apparatus without the help of a service person. This leads to a drastic improvement in operability.

The electrophotographic image forming apparatus includes a fixing device including a heat source to fix a toner image on a sheet. Japanese Patent Laid-Open No. 2013-224987 discusses a structure including a fixing shutter so as to prevent a user from touching the heat source of the fixing device or a portion heated by the heat source in a state where a cartridge is detached from the main body of the image forming apparatus.

In the structure discussed in Japanese Patent Laid-Open No. 2013-224987, the fixing shutter is caused to move between an open position and a closed position by an opening/closing force of an opening/closing member (door) that is opened to attach or detached the cartridge to or from the main body of the image forming apparatus. For this reason, a large force transmission mechanism is required to transmit a face between the opening/closing member and the fixing shutter, which leads to an increase in size and cost of the main body of the image forming apparatus.

Not only in the fixing shutter, but also in a structure in which a movable member that moves between two positions and the force transmission mechanism that transmits a force to the movable member to move movable member are provided, as the size of the force transmission mechanism increases, the size and cost of the main body of the image forming apparatus increase.

SUMMARY

A first aspect is a cartridge detachably attachable to a main body of an image forming apparatus, the main body including: a fixing portion that includes a heating rotation member and that heat-fixes a toner image on a sheet; and a mounting portion on which the cartridge is mounted, the fixing portion including a fixing shutter configured to be movable between a first position where a part of the heating rotation member is covered and a second position where the part of the heating rotation member is exposed, the fixing shutter including a force receiving portion configured to receive a force for causing the fixing shutter to move from the first position to the second position, the cartridge including a photosensitive member, a frame configured to support the photosensitive member so that the photosensitive member is rotatable, and a pressing portion configured to press the force receiving portion while the cartridge is being mounted on the mounting portion.

A second aspect is an image forming apparatus including a cartridge including a photosensitive member, a frame configured to support the photosensitive member so that the photosensitive member is rotatable, and a pressing portion; and a main body including a fixing portion that includes a heating rotation member and that heat-fixes a toner image on a sheet, and a mounting portion on which the cartridge is mounted. The fixing portion includes a fixing shutter configured to be movable between a first position where a part of the heating rotation member is covered and a second position where the part of the heating rotation member is exposed. The fixing shutter includes a force receiving portion configured to receive a force for the fixing shutter to move from the first position to the second position. While the cartridge is being mounted on the mounting portion, the pressing portion of the cartridge presses the force receiving portion of the fixing shutter to move the fixing shutter from the first position to the second position.

Further features will become apparent from the following description of exemplary embodiments (with reference to the attached drawings).

DESCRIPTION OF THE EMBODIMENTS

Exemplary embodiments will be described in detail with reference to drawings below. Assume herein that a rotation axial line direction of an electrophotographic photosensitive drum (hereinafter referred to as a photosensitive drum) corresponds to a longitudinal direction. In the longitudinal direction, a side where a rotary force is transmitted to a development cartridge from a main body of an image forming apparatus is referred to as a "drive side". The opposite side of the drive side is referred to as a "non-drive side". A frontage side (opening/closing member 13 side illustrated in FIG. 2) where the process cartridge is taken out of the main body of an image forming apparatus A is referred to as a front surface of the main body of the image forming apparatus A, and the opposite side of the front surface is referred to as a back surface of the main body of the image forming apparatus A. An upper portion (a stacking surface on which a recording medium P is stacked in FIG. 2 to be described below) of the main body of the image forming apparatus A in an installation state is referred to as an upper portion of the main body of the image forming apparatus A. The opposite side of the upper portion is referred to as a lower portion of the main body of the image forming apparatus A.

Figure 2:
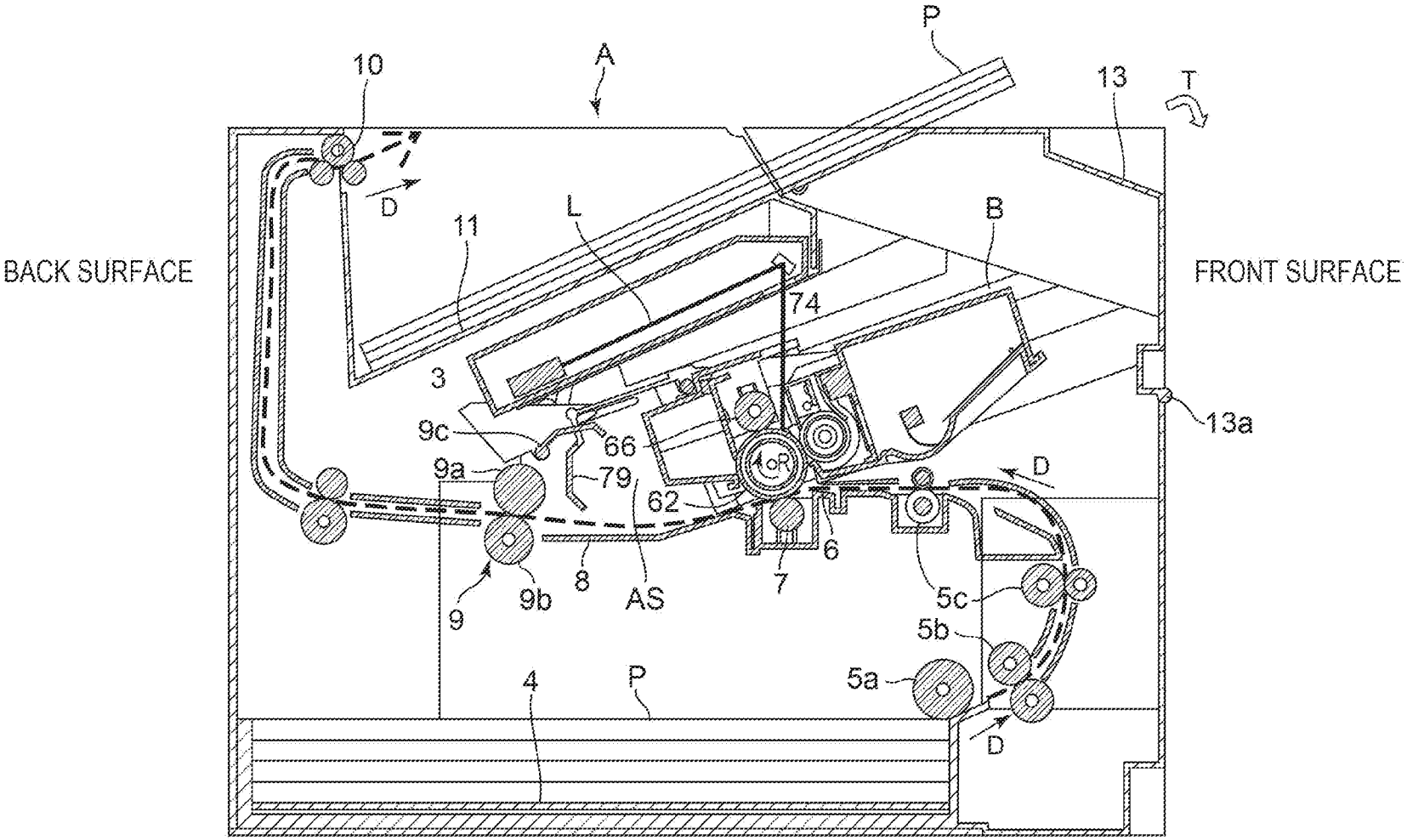
FIG. 2 is a schematic sectional view illustrating an electrophotographic image forming apparatus.
Figure 3:
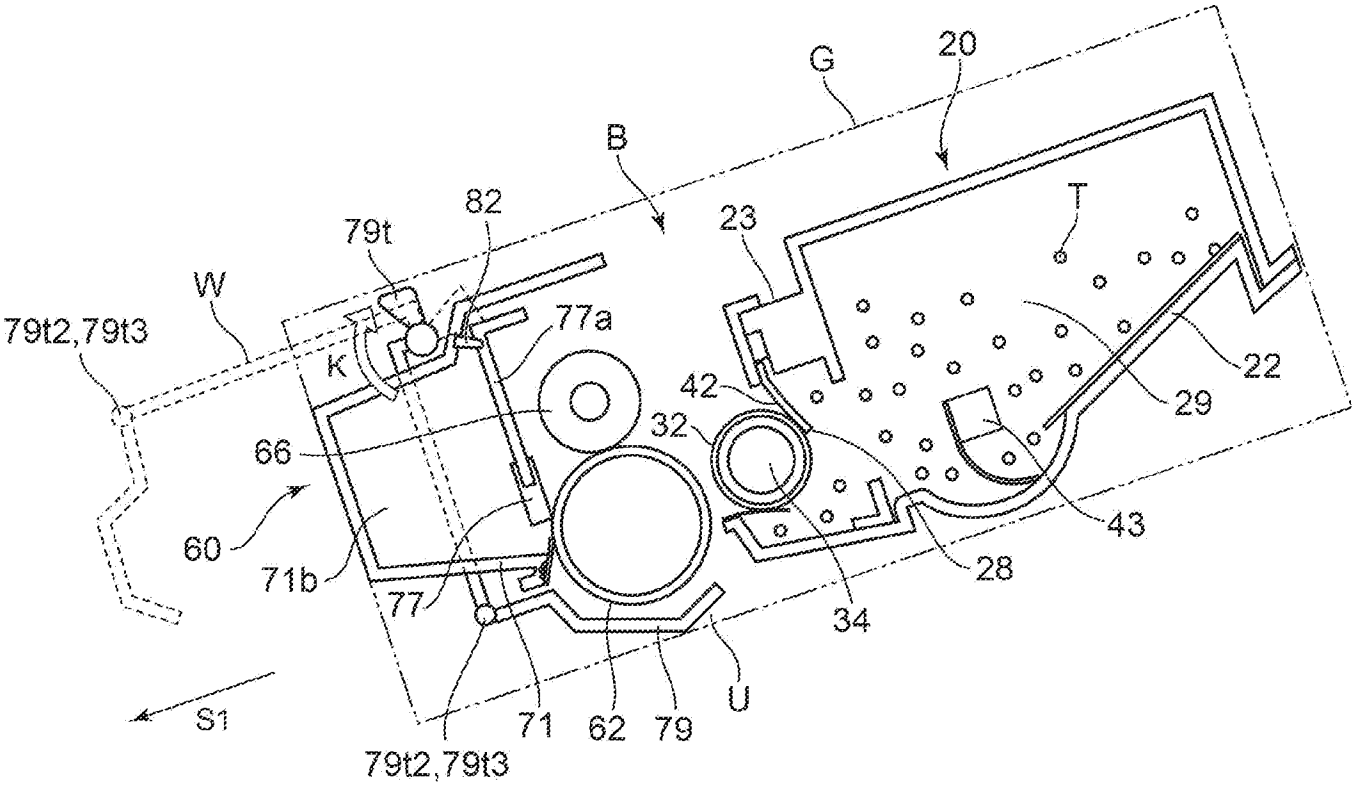
FIG. 3 is a schematic sectional view illustrating the cartridge.

An overall structure and an image forming process will be described with reference to FIGS. 2 and 3. FIG. 2 is a sectional view illustrating the main body of the image forming apparatus A according to an exemplary embodiment. FIG. 3 is a sectional view illustrating a process cartridge (hereinafter referred to as a cartridge B). The main body of the image forming apparatus A refers to the portion of the electrophotographic image forming apparatus that is obtained by removing the cartridge B from the electrophotographic image forming apparatus.

[Overall Structure of Image Forming Apparatus]

Referring to FIG. 2, the image forming apparatus is a laser beam printer using an electrophotographic technique that enables mounting of the cartridge B on the main body of the image forming apparatus A and enables dismounting of the cartridge B from the main body of the image forming apparatus A. When the cartridge B is mounted on an cartridge accommodating portion AS of the main body of the image forming apparatus A, an exposure device 3 (laser scanner unit) is disposed on the upper side of the cartridge B.

A sheet tray 4 that accommodates a recording medium (hereinafter referred to as a sheet material P) on which an image is formed is disposed on the lower side of the cartridge B. Further, in the main body of the image forming apparatus A, a pickup roller 5*a*, a feed roller pair 5*b*, a conveyance roller pair 5*c*, a transfer guide 6, a transfer roller 7, a conveyance guide 8, a fixing device 9, a discharge roller pair 10, a discharge tray 11, and the like are sequentially arranged along a conveyance direction D of the sheet material P. The fixing device 9 includes a heating roller 9*a*, a pressing roller 9*b*, a fixing shutter 9*c* serving as a movable member, and a locking member 9*d* (see FIGS. 1A to 1C) serving as a regulating member.

[Image Forming Process]

Next, an outline of the image forming process will be described. Based on a print start signal, a photosensitive drum 62 is rotationally driven at a predetermined circumferential velocity (process speed) in a direction indicated by an arrow R. A charging roller 66 to which a bias voltage is applied contacts an outer peripheral surface of the photosensitive drum 62 to uniformly charge the outer peripheral surface of the photosensitive drum 62.

The exposure device 3 outputs a laser beam L based on image information. The laser beam L passes through an exposure window portion 74 on the upper surface of the cartridge B to perform scanning exposure on the outer peripheral surface of the photosensitive drum 62. As a result, an electrostatic latent image corresponding to image information is formed on the outer peripheral surface of the photosensitive drum 62.

On the other hand, as illustrated in FIG. 3, in a development unit 20 serving as a development device, toner T contained in a toner chamber 29 is stirred and conveyed by the rotation of a conveyance member 43, and is then sent to a toner supply chamber 28. The toner T is borne on the surface of a development roller 32 by a magnetic force of a magnet roller 34 (stationary magnet). The layer thickness of the peripheral surface of the development roller 32 is regulated while the toner T is triboelectrically charged by a development blade 42. The toner T is transferred onto the surface of the photosensitive drum 62 according to an electrostatic latent image and is visualized as a toner image.

Further, as illustrated in FIG. 2, the sheet material P accommodated in the lower portion of the main body of the image forming apparatus A is fed in a direction indicated by an arrow D from the sheet tray 4 by the pickup roller 5*a*, the feed roller pair 5*b*, and the conveyance roller pair 5*c* at an output timing of the laser beam L.

Further, the sheet material P passes through the transfer guide 6 and is supplied to a transfer position between the photosensitive drum 62 and the transfer roller 7. At the transfer position, the toner image is sequentially transferred onto the sheet material P from the photosensitive drum 62. The sheet material P having the toner image transferred thereon is separated from the photosensitive drum 62 and is conveyed to the fixing device (fixing unit) 9 along the conveyance guide 8. Then, the sheet material P passes through a nip portion between the heating roller 9*a*, which serves as a heat source constituting the fixing device 9, and the pressing roller 9*b*. The toner image pressed and subjected to heating processing at the nip portion is fixed onto the sheet material P. The sheet material P having the toner image fixed thereon is conveyed to the discharge roller pair 10 and is discharged onto the discharge tray 11. Any structure may be used as the fixing device 9, as long as the fixing device 9 includes a heat source. In the present exemplary embodiment, the heating roller 9*a* including a heater is used as the heat source. However, the heater itself or a heat source member whose surface is heated by the heater or which generates heat as a heat source may be used as the heat source instead of the heating roller 9*a*. The shape of the heat source member may be a film shape (endless belt shape) or a roller shape.

On the other hand, as illustrated in FIG. 3, after the toner is transferred onto the photosensitive drum 62, residual toner is removed from the outer peripheral surface of the photosensitive drum 62 by a cleaning blade 77, and the residual toner is re-used for the image forming process. The toner removed from the photosensitive drum 62 is stored in a waste toner chamber 71*b* of a cleaning unit 60. In the exemplary embodiment described above, the charging roller 66, the development roller 32, and the cleaning blade 77 each serve as a process unit that acts on the photosensitive drum 62.

[Overall Structure of Cartridge]

Figure 4:
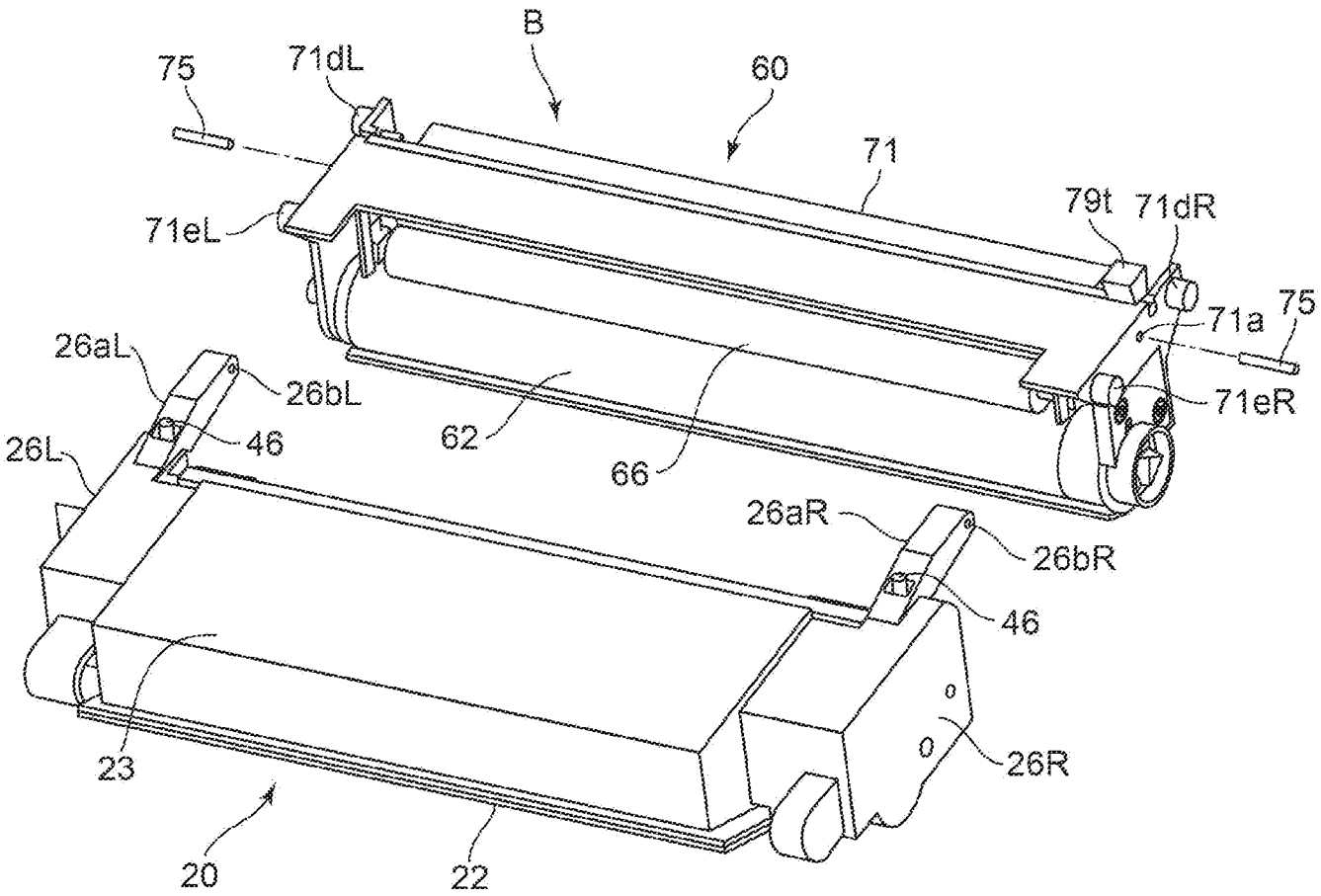
FIG. 4 is an assembly explanatory diagram illustrating a development cartridge and a drum cartridge.

Next, an overall structure of the cartridge B will be described with reference to FIGS. 3 and 4. FIG. 4 is an assembly explanatory diagram illustrating a development cartridge (development unit 20) and a drum cartridge (cleaning unit 60) according to the present exemplary embodiment. The cartridge B has a structure in which the cleaning unit 60 and the development unit 20 are integrated.

The cleaning unit 60 includes a cleaning frame 71, which serves as a container, the photosensitive drum 62, the charging roller 66, and the cleaning blade 77 (FIG. 3). The photosensitive drum 62, the charging roller 66, and the cleaning blade 77 are supported by the cleaning frame (first frame) 71.

On the other hand, as illustrated in FIG. 3, the development unit 20 includes a bottom member 22, a development container 23, the development blade 42, the development roller 32, the magnet roller 34, and a conveyance member 43. As illustrated in FIG. 4, the development unit 20 includes a first side member 26L, a second side member 26R, and an urging member 46. The development container 23 accommodates the toner T. The development roller 32 is a development member that is used to attach toner to the surface of the photosensitive drum 62, and is supported by the development container. The bottom member 22, the development container 23, the first side member 26L, and the second side member 26R constitute a development frame (second frame) as a frame of the development unit 20. The cleaning unit 60 and the development unit 20 are pivotally coupled by a coupling member 75, thereby forming the cartridge B.

Further, rotation holes 26*b*L and 26*b*R which are parallel to the development roller 32 are respectively provided at leading edges of arm portions 26*a*L and 26*a*R which are formed in the first side member 26L and the second side member 26R at both ends in the longitudinal direction of the development unit 20 (in the axial line direction of the development roller 32). At the both ends in the longitudinal direction of the cleaning frame 71, fitting holes 71*a* (the fitting holes 71*a* formed on the non-drive side is not illustrated) for fitting the coupling member 75 are formed.

The arm portions 26*a*L and 26*a*R are aligned with predetermined positions of the cleaning frame 71 and the coupling member 75 is inserted into the rotation holes 26*b*L and 26*b*R and the fitting holes 71*a*. As a result, the cleaning unit 60 and the development unit 20 are pivotally coupled together about the coupling member 75. In this case, the urging member 46 attached to a base of each of the arm portions 26*a*L and 26*a*R contacts the cleaning frame 71 to urge the development unit 20 against the cleaning unit 60 with the coupling member 75 as a rotational center.

As a result, the development roller 32 is reliably pressed in the direction of the photosensitive drum 62. Further, space holding members (not illustrated) which are attached to the both ends of the development roller 32 enables the development roller 32 to be held at a predetermined interval from the photosensitive drum 62.

[Structure of Movable Member (Drum Shutter)]

Figure 5A:
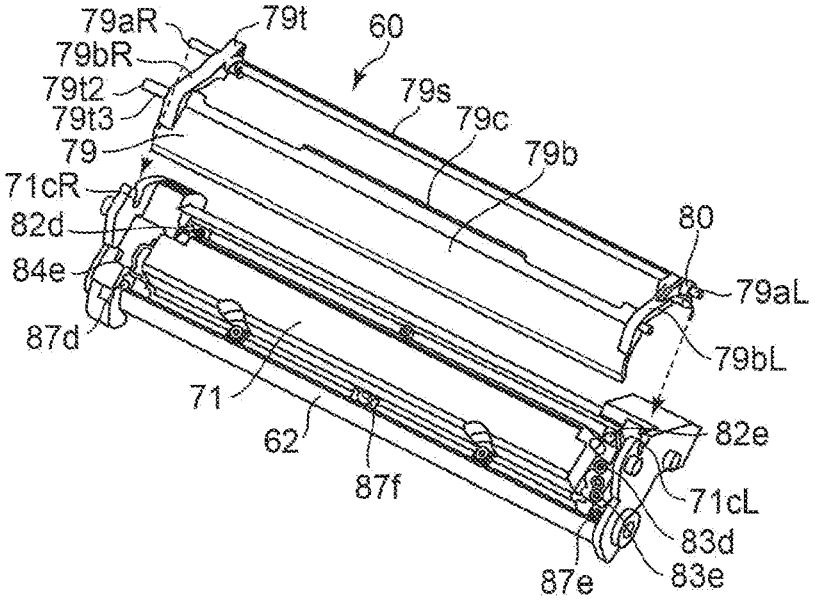
FIG. 5A is a perspective view illustrating a cleaning unit before a drum shutter is assembled.
Figure 5B:
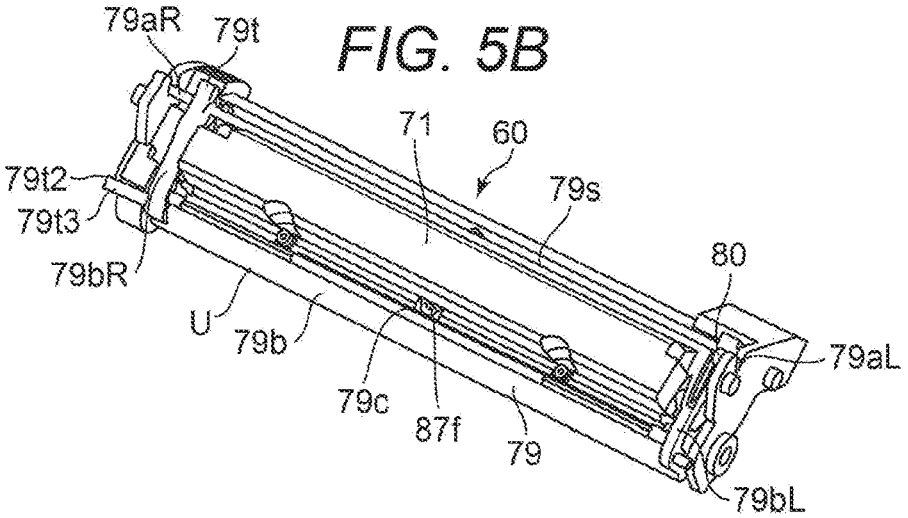
FIG. 5B is a perspective view after assembly of the cleaning unit after the drum shutter is assembled.
Figure 5C:
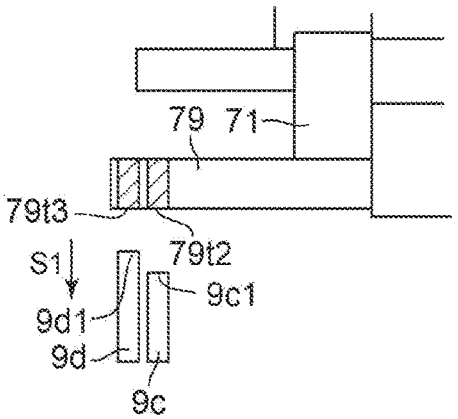
FIG. 5C is a view illustrating the vicinity of a first protrusion **79*t*2 and a second protrusion 79*t*3 of a drum shutter 79 as viewed along a direction orthogonal to an axial line of a photosensitive drum 62**.

The structure of the drum shutter (photosensitive member shutter) will be described in detail with reference to FIGS. 3 and 5A to 5C. FIG. 5A is a perspective view illustrating the cleaning unit before the drum shutter is assembled. FIG. 5B is a perspective view illustrating the cleaning unit after the drum shutter is assembled. As illustrated in FIGS. 5A to 5C, the cleaning unit 60 includes an openable/closable drum shutter (movable member) 79 that moves to the cleaning frame 71 and includes a protecting portion (covered portion) 79*b* for covering and protecting the photosensitive drum 62.

The drum shutter 79 includes a support shaft 79*s*, and a drive-side axial portion 79*a*R and a non-drive-side axial portion 79*a*L which are located at the both ends in the longitudinal direction. The both axial portions 79*a*R and 79*a*L are coupled by the support shaft 79*s*. The drum shutter 79 includes drive-side arm 79*b*R and a non-drive-side arm 79*b*L which are provided at the both ends in the longitudinal direction as a coupling portion that couples the protecting portion 79*b* and the support shaft 79*s*.

At the both ends in the longitudinal direction of the cleaning frame 71, bearing portions 71*c*R and 71*c*L for fitting the axial portions 79*a*R and 79*a*L are provided. An urging member 80, which is a torsion coil spring, is attached to the non-drive-side axial portion 79*a*L of the drum shutter 79. The drive-side axial portion 79*a*R and the non-drive-side axial portion 79*a*L of the drum shutter 79 are respectively fit to the bearing portions 71*c*R and 71*c*L of the cleaning frame 71 in a direction indicated by a broken line arrow in FIG. 5A. Thus, the assembly of the drum shutter 79 to the cleaning frame 71 is completed.

As illustrated in FIG. 3, the assembled drum shutter 79 is pivotally supported by the cleaning frame 71 so as to be movable to a protecting position (covered position) U and an exposure position W. The protecting position U is a position of the drum shutter 79 which is indicated by a solid line in FIG. 3 and is a closed position at which the protecting portion 79*b* covers the photosensitive drum 62. The exposure position W is a position of the drum shutter 79 which is indicated by a dashed line in FIG. 3 and is an open position at which the photosensitive drum 62 is not covered by the protecting portion 79*b* and the photosensitive drum 62 is exposed. The drum shutter 79 is urged by the urging member 80 so as to move toward the protecting position U from the exposure position W.

In the vicinity of the drive-side axial portion 79*a*R, a third protrusion 79*t* which serves as a force receiving portion that receives a force for performing an opening/closing operation for the drum shutter 79. Further the drum shutter 79 includes a first protrusion 79*t*2 which serves as a first pressing portion (pressing portion) used to perform an opening/closing operation for a fixing shutter 9*c* to be described below, and a second protrusion 79*t*3 which serves as a second pressing portion used to perform a release operation for the locking member 9*d*. FIG. 5C is a view illustrating the vicinity of the first protrusion 79*t*2 and the second protrusion 79*t*3 of the drum shutter 79 as viewed along a direction orthogonal to the axial line of the photosensitive drum 62. As illustrated in FIG. 5C, the first protrusion 79*t*2 and the second protrusion 79*t*3 are protrusions that protrude toward the outside of the outer shape of the cleaning frame 71. The positions of the first protrusion 79*t*2 and the second protrusion 79*t*3 in the longitudinal direction are different. The first protrusion 79*t*2 and the second protrusion 79*t*3 act on the fixing shutter 9*c* and the locking member 9*d*, respectively.

A line which corresponds to an outermost portion of the cartridge B and is parallel or perpendicular to a mounting direction S1 as viewed along an axial direction of the photosensitive drum 62 is defined as an outer shape G (a rectangle indicated by a dashed-two dotted line in FIG. 3. As viewed along the axial direction of the photosensitive drum 62, an outer shape G is a rectangle formed by two sides parallel to each other in the mounting direction S1 and two sides orthogonal to the mounting direction S1 and the axial line direction of the photosensitive drum 62. The length of each side corresponds to a maximum width in the mounting direction S1 of the cartridge B when the drum shutter 79 is located at the protecting position U, and also corresponds to a maximum width in the mounting direction S1 and the axial line direction of the photosensitive drum 62. In this case, the first protrusion 79*t*2 and the second protrusion 79*t*3 are located on the inside of the outer shape G at the protecting position U, and are located on the outside of the outer shape G or the frame (cleaning frame 71 and development frame) of the cartridge B at the exposure position W. In particular, when the drum shutter 79 is located at the exposure position W, the first protrusion 79*t*2 and the second protrusion 79*t*3 are disposed at a position on the downstream side of the outer shape G or the frame of the cartridge B in the mounting direction S1. The mounting direction S1 is a direction in which the cleaning frame (first frame) 71 and the development frame (second frame) are arranged.

The above-described outer shape G is indicated by a rectangle having sides which are parallel to the mounting direction S1 and the direction orthogonal to the mounting direction S1 and the axial line direction of the photosensitive drum 62 when the cartridge B positioned when the drum shutter 79 is located at the protecting position U is viewed along the axial line direction of the photosensitive drum 62. However, the outer shape G is not limited to this shape. For example, the outer shape G may be indicated by a rectangle or the like having sides which are parallel to the axial line direction of the photosensitive drum 62 and the direction orthogonal to the axial line direction of the photosensitive drum 62 as viewed along the direction orthogonal to the axial line direction of the photosensitive drum 62.

[Structure of Movable Member (Fixing Shutter)]

Figure 1A:
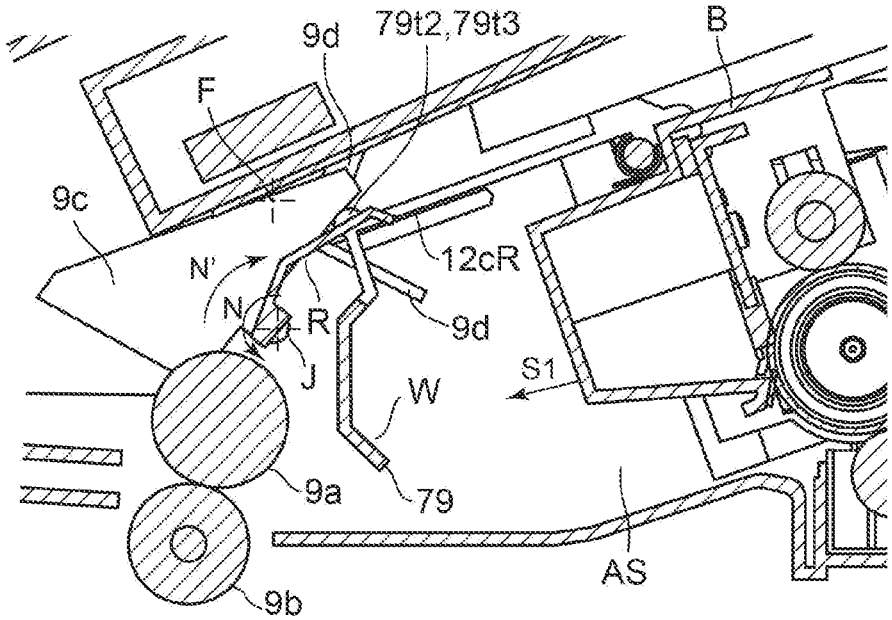
FIG. 1A is a sectional view illustrating a relationship between a fixing shutter and a cartridge positioned and mounted on a main body of an image forming apparatus as viewed along a direction orthogonal to an axial line direction of a photosensitive drum.
Figure 1B:
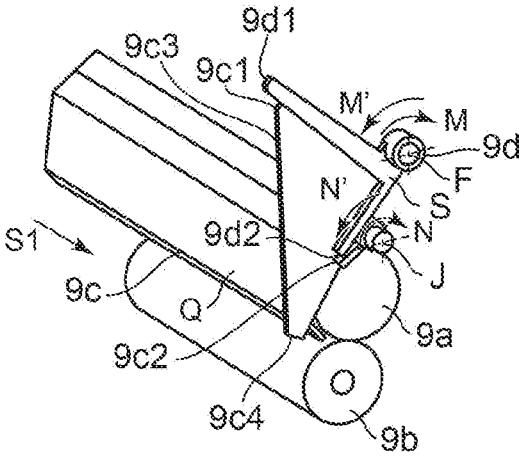
FIG. 1B is a perspective view illustrating the fixing shutter, a locking member, and a fixing roller within the main body of the image forming apparatus as viewed from a drive side direction in a state before mounting the cartridge.
Figure 1C:
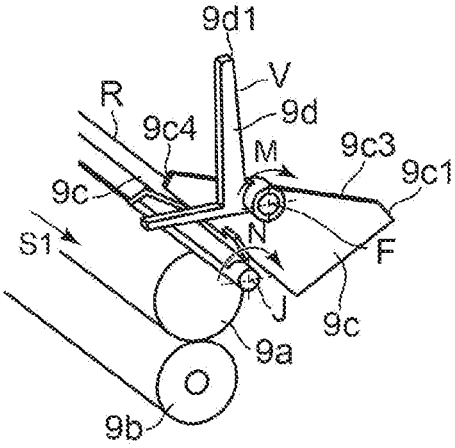
FIG. 1C is a perspective view illustrating the fixing shutter, the locking member, and the fixing roller within the main body of the image forming apparatus as viewed from the drive side direction in a state after mounting of the cartridge.

The structure of the fixing shutter 9*c* serving as a first movable member will be described in detail with reference to FIG. 1. FIG. 1A is a sectional view illustrating a relationship between the fixing shutter and the cartridge mounted and positioned on the main body of the image forming apparatus A as viewed along a direction orthogonal to the axial line direction of the photosensitive drum 62. FIG. 1B is a perspective view illustrating the fixing shutter, the locking member, and the fixing roller within the main body of the image forming apparatus as viewed along the drive side direction in a state before mounting of the cartridge. FIG. 1C is a perspective view illustrating the fixing shutter, the locking member, and the fixing roller within the main body of the image forming apparatus as viewed along the drive side direction in a state after mounting of the cartridge.

The fixing device 9 is disposed on the downstream side of the cartridge accommodating portion AS in the mounting direction S1. In this case, the fixing shutter 9*c* serving as a movable member is pivotally supported on the main body of the image forming apparatus A with a rotational center J as a center between a closed position (first position) Q and an open position (second position) R. The closed position Q is a closed position where the heating roller (heating rotation member) 9*a*, which is a heat source, is covered so as to prevent a finger of the user from touching the heating roller 9*a* as illustrated in FIG. 1B. The open position R is a position where the heating roller 9*a* and the pressing roller 9*b* are exposed to convey the sheet having the toner image transferred thereon between the heating roller 9*a* and the pressing roller 9*b* as illustrated in FIG. 1C. Further, the fixing shutter 9*c* is urged against the closed position Q in a direction indicated by an arrow N' by a spring (urging member) which is not illustrated.

The locking member 9*d* serving as a regulating member is pivotally supported on the main body of the image forming apparatus A with a rotational center F as a center between a lock position (regulating position) S and a release position (non-regulating position) V. As illustrated in FIG. 1B, the lock position S is a position where a contact portion 9*d*2 contacts a contact portion 9*c*2 of the fixing shutter 9*c* to prevent the fixing shutter 9*c* from being rotated in a direction indicated by an arrow N from the closed position Q and moving to the open position R. The release position V is a position where the regulation of the fixing shutter 9*c* when the fixing shutter 9*c* is located at the lock position S is released to allow the fixing shutter 9*c* to be pivotable to the open position R. Further, the locking member 9*d* is urged against the lock position S by a spring (urging member), which is not illustrated, in a direction indicated by an arrow M'. The locking member 9*d* is also a second movable member.

[Attaching/Detaching and Positioning of Cartridge]

Figure 6A:
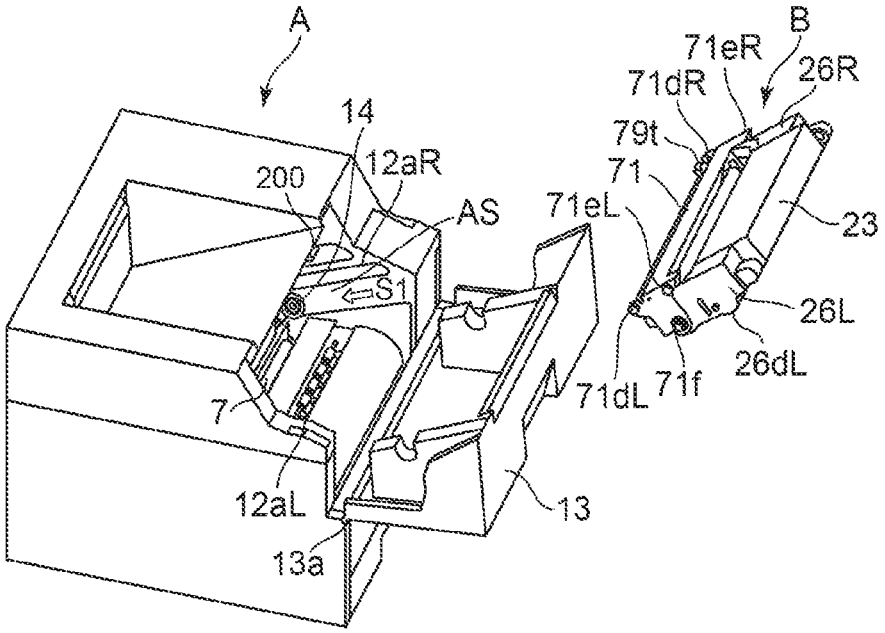
FIG. 6A is a perspective view illustrating the main body of the image forming apparatus and the cartridge before the cartridge is inserted into the main body of the image forming apparatus.
Figure 6B:
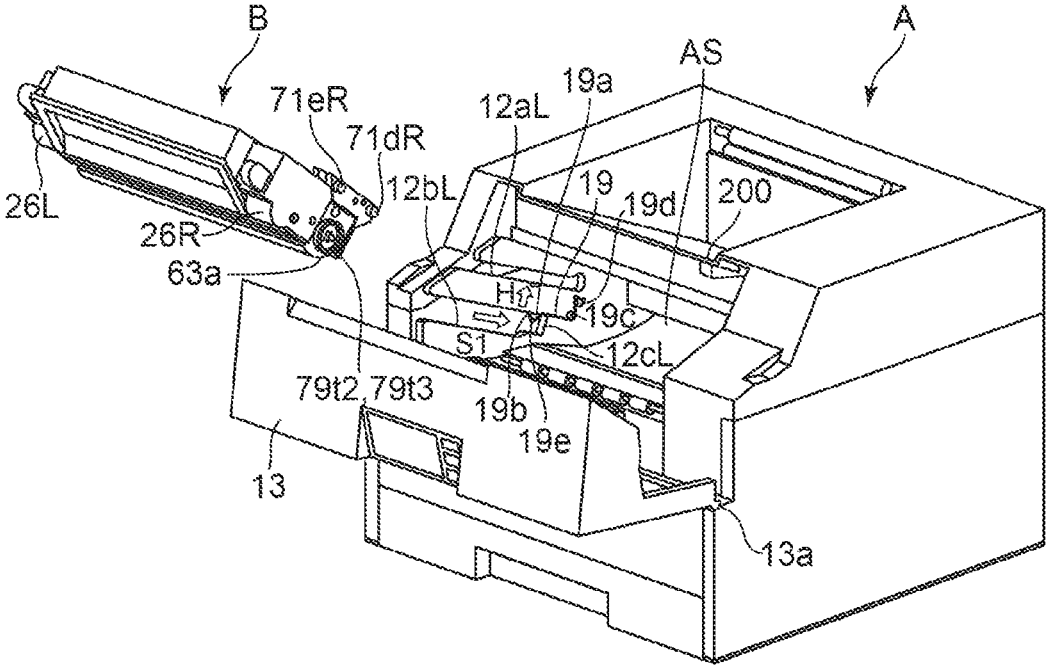
FIG. 6B is a perspective view illustrating the main body of the image forming apparatus and the cartridge before the cartridge is inserted into the main body of the image forming apparatus.
Figure 7A:
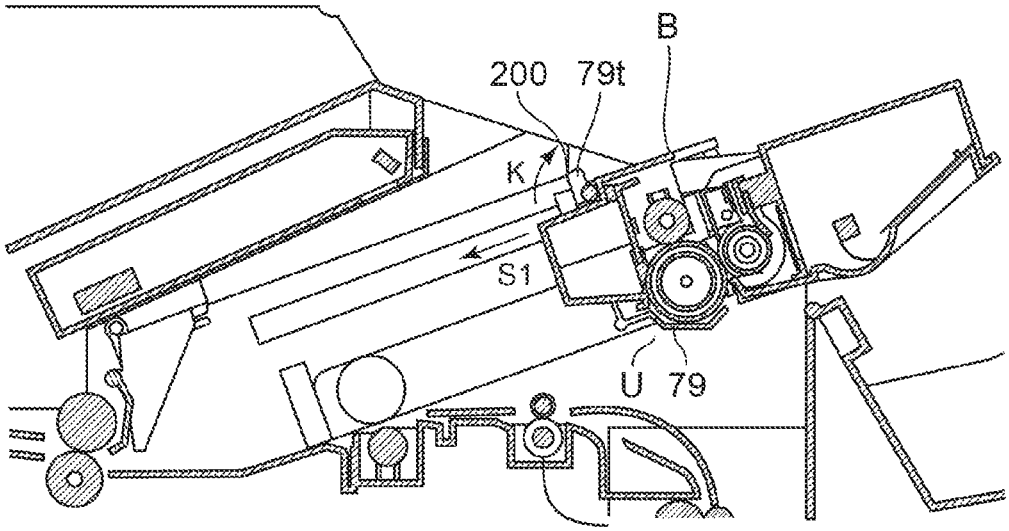
FIG. 7A is a sectional view illustrating the main body of the image forming apparatus and the cartridge in the process of mounting the cartridge on the main body of the image forming apparatus as viewed along a direction orthogonal to the axial line direction of the photosensitive drum.
Figure 7B:
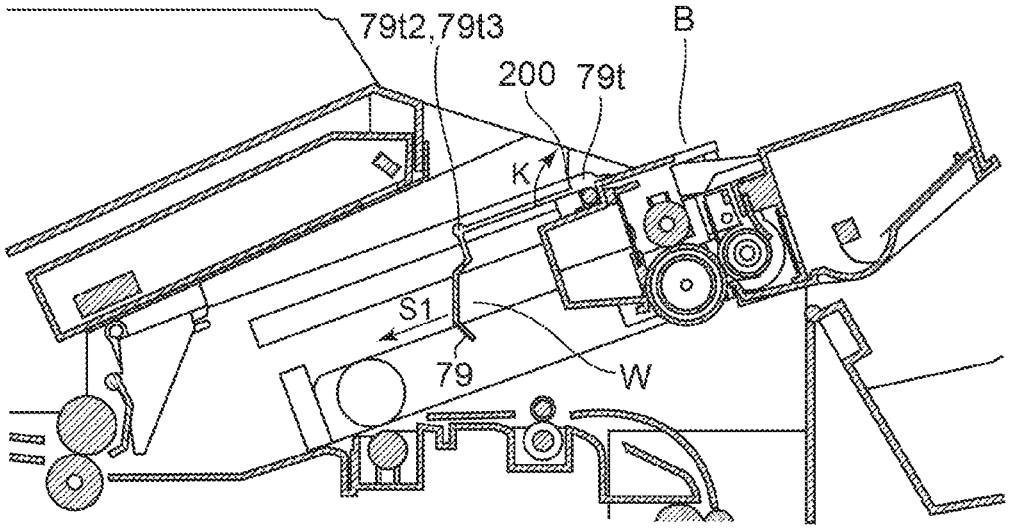
FIG. 7B is a sectional view illustrating the main body of the image forming apparatus and the cartridge in the process of mounting the cartridge on the main body of the image forming apparatus as viewed along a direction orthogonal to the axial line direction of the photosensitive drum.
Figure 8A:
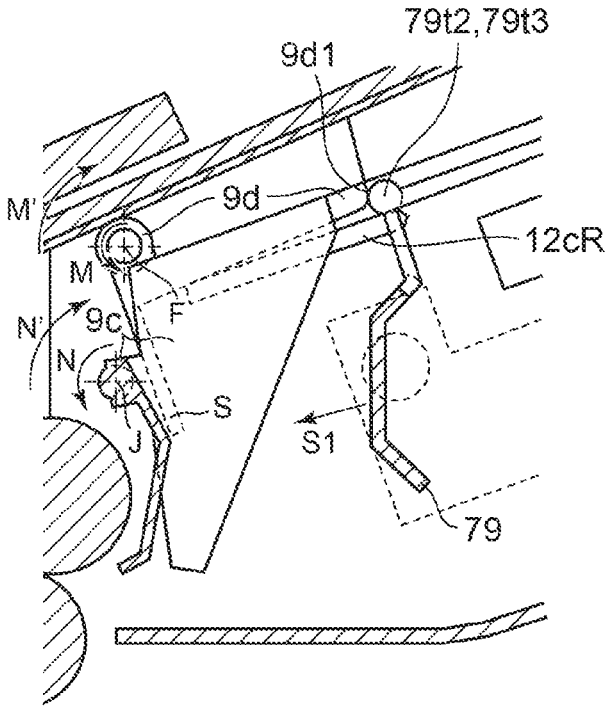
FIG. 8A is a partial perspective view illustrating the main body of the image forming apparatus and the cartridge during movement of the locking member in the process of mounting the cartridge on the main body of the image forming apparatus as viewed along a direction orthogonal to the axial line direction of the photosensitive drum.
Figure 8B:
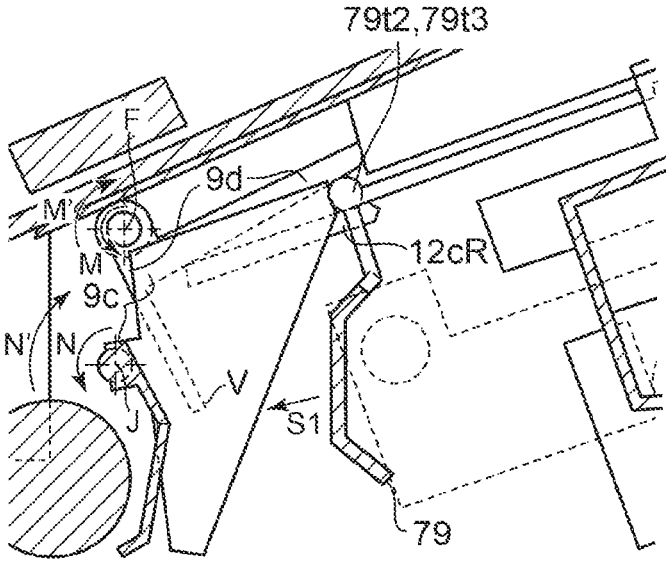
FIG. 8B is a partial sectional view illustrating the main body of the image forming apparatus and the cartridge during movement of the locking member in the process of mounting the cartridge on the main body of the image forming apparatus as viewed along a direction orthogonal to the axial line direction of the photosensitive drum.
Figure 9A:
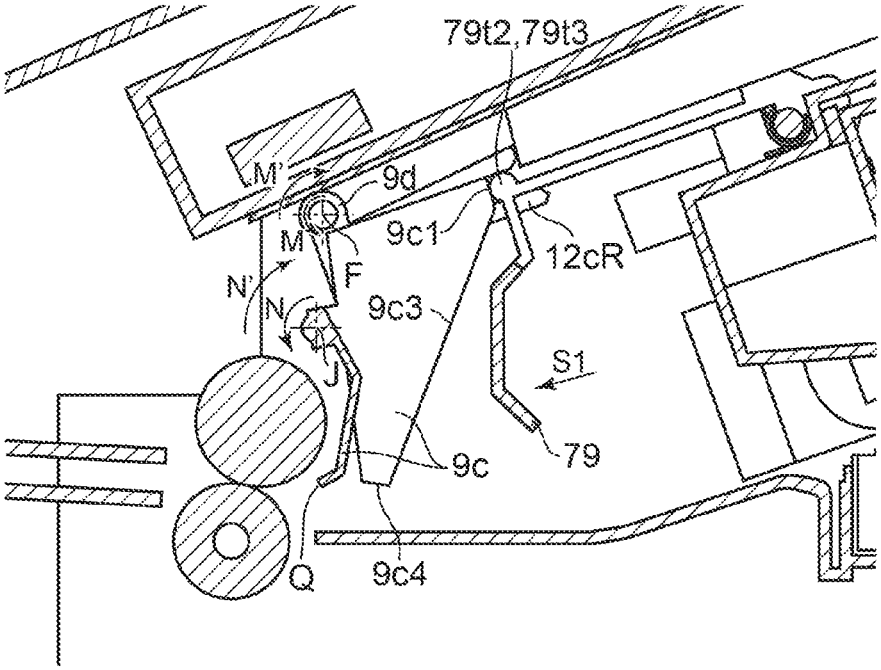
FIG. 9A is a partial sectional view illustrating the main body of the image forming apparatus and the cartridge during movement of the fixing shutter in the process of mounting the cartridge on the main body of the image forming apparatus as viewed along a direction orthogonal to the axial line direction of the photosensitive drum.
Figure 9B:
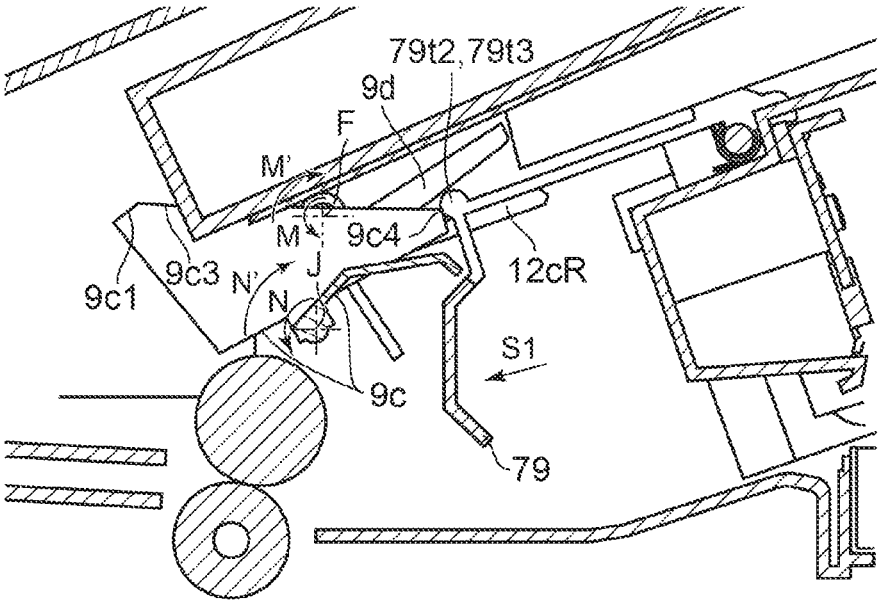
FIG. 9B is a partial sectional view illustrating the main body of the image forming apparatus and the cartridge during movement of the fixing shutter in the process of mounting the cartridge on the main body of the image forming apparatus as viewed along a direction orthogonal to the axial line direction of the photosensitive drum.

Next, attaching/detaching and positioning of the cartridge B with respect to the main body of the image forming apparatus A and motions of the drum shutter and the fixing shutter during attaching/detaching and positioning of the cartridge B will be described with reference to FIGS. 1A to 1C and 6A to 9B. FIGS. 6A and 6B are perspective views each illustrating the cartridge and the main body of the image forming apparatus before the cartridge is inserted into the main body of the image forming apparatus. FIGS. 7A and 7B are sectional views each illustrating the cartridge and the main body of the image forming apparatus in the process of mounting the cartridge on the main body of the image forming apparatus as viewed along a direction orthogonal to the axial line direction of the photosensitive drum. FIGS. 8A and 8B are partial sectional views each illustrating the cartridge and the main body of the image forming apparatus during movement of the locking member in the process of mounting the cartridge on the main body of the image forming apparatus as viewed along a direction orthogonal to the axial line direction of the photosensitive drum. FIGS. 9A and 9B are partial sectional views each illustrating the cartridge and the main body of the image forming apparatus during movement of the fixing shutter in the process of mounting the cartridge on the main body of the image forming apparatus as viewed along a direction orthogonal to the axial line direction of the photosensitive drum.

As illustrated in FIGS. 6A and 6B, the main body of the image forming apparatus A is provided with an opening/closing member 13 which is pivotally attached with a pivot axis 13*a* as a rotational center. When the opening/closing member 13 is opened in a direction indicated by an arrow T in FIG. 2, as illustrated in FIGS. 6A and 6B, the main body of the image forming apparatus A is in a state where the cartridge B can be inserted into or removed from the cartridge accommodating portion AS provided in the main body of the image forming apparatus A. On the inside surface of the main body of the image forming apparatus A, a drive-side guide rail 12*a*R and a non-drive-side guide rail 12*a*L which guide the movement of the cartridge B are provided so that the cartridge B is moved to a position for image formation when the cartridge B is inserted into the main body of the image forming apparatus A. Each of the drive-side guide rail 12*a*R and the non-drive-side guide rail 12*a*L includes a guide surface parallel to the mounting direction S1 and has a shape extending in a direction parallel to the mounting direction S1. The position for image formation is a position of the cartridge B when the cartridge B is mounted on the cartridge accommodating portion AS illustrated in FIG. 2.

At both side surfaces in the longitudinal direction of the cleaning frame 71 of the cartridge B, drive-side bosses 71*d*R and 71*e*R and non-drive-side bosses 71*d*L and 71*e*L are provided. The cartridge B is inserted into the mounting direction S1 while the drive-side bosses 71*d*R and 71*e*R are caused to contact (guide) the guide surface of the drive-side guide rail 12*a*R and the non-drive-side bosses 71*d*L and 71*e*L are caused to contact (guide) the guide surface of the non-drive-side guide rail 12*a*L, respectively. As a result, a cylindrical portion 71*f* of the cartridge B is brought into contact (is guided) to a lower guide 12*b*L.

Further, when the cartridge B is inserted in the mounting direction S1, as illustrated in FIG. 7A, the third protrusion 79*t* contacts a contact portion 200 of the main body and the drum shutter 79 is opened in a direction indicated by an arrow K (also see FIG. 3), and the drum shutter 79 is opened as illustrated in FIG. 7B. In this case, as illustrated in FIG. 3, the first protrusion 79*t*2 and the second protrusion 79*t*3 protrude toward the outside of the outer shape G as viewed along the axial direction of the photosensitive drum, and are disposed at positions where the first protrusion 79*t*2 and the second protrusion 79*t*3 can contact the fixing shutter 9*c* and the locking member 9*d*.

Further, when the cartridge B is inserted in the mounting direction S1, as illustrated in FIG. 8A, the first protrusion 79*t*2 and the second protrusion 79*t*3 start to contact the drive-side guide portion 12*c*R which is parallel to the mounting direction S1.

Further, when the cartridge B is inserted in the mounting direction S1, as illustrated in FIG. 8B, the second protrusion 79*t*3 contacts a contact portion (another force receiving portion) 9*d*1 of the locking member 9*d* while contacting the drive-side guide portion 12*c*R. As a result, the locking member 9*d* rotates in a direction indicated by an arrow M with the rotational center F as a center. The locking member 9*d* is rotated in the direction indicated by the arrow M and moves from the lock position S to the release position V, so that the fixing shutter 9*c* can pivot about the rotational center J in a direction indicated by an arrow N with respect to the fixing device 9.

Further, when the cartridge B is inserted in the mounting direction S1, as illustrated in FIGS. 9A and 9B, the first protrusion 79*t*2 sequentially contacts contact portions (force receiving portions) 9*c*1, 9*c*3, and 9*c*4 of the fixing shutter 9*c* while contacting the drive-side guide portion 12*c*R and moving in the mounting direction S1. As a result, the fixing shutter 9*c* is rotated in the direction indicated by the arrow N. The fixing shutter 9*c* is rotated in the direction indicated by the arrow N, the fixing shutter 9*c* moves from the closed position Q to the open position R (see FIGS. 1A to 1C) and is opened.

Further, when the cartridge B is inserted in the mounting direction S1, the cylindrical portion 71*f* (see FIG. 6A) contacts a positioning portion 12*c*L (see FIG. 6A) and mounting of the cartridge B on the main body of the image forming apparatus A is completed. That is, the cartridge B can be positioned at the position for image formation (position of the cartridge B as illustrated in FIGS. 1A and 2).

As illustrated in FIG. 2, when the cartridge B is located at the position for image formation, the photosensitive drum 62 is brought into contact with the transfer roller 7. Accordingly, the main body of the image forming apparatus A is provided with a retracting spring 19 (see FIG. 6B) that causes the cartridge B to be retracted. The retracting spring 19 is pivotally supported at a pivot axis 19*c*, and the position of the retracting spring 19 is fixed on the main body of the image forming apparatus A by a locking portion 19*d*.

When the user inserts the cartridge B in the mounting direction S1, as illustrated in FIG. 6B, the cylindrical portion 71*f* (see FIG. 6A) of the cartridge B and an operating portion 19*b* of the retracting spring 19 contact, so that the retracting spring 19 moves in a direction indicated by an arrow H.

The cylindrical portion 71*f* of the cartridge B runs over the corner portion 19*e* of the retracting spring 19 and contacts an urging portion 19*a*, so that the cylindrical portion 71*f* of the cartridge B receives an urging force and contacts the positioning portion 12*c*L of the main body of the image forming apparatus, thereby positioning the cartridge B at the position for image formation.

In this case, the position for image formation is a position where the photosensitive drum 62 faces the transfer roller 7 and a drive input shaft 14 driven by a motor (not illustrated) of the main body of the image forming apparatus A can lock with a driving force receiving portion 63*a* (see FIG. 6B) provided on the cartridge B.

Next, the operation of each of the fixing shutter 9*c* and the drum shutter 79 when the cartridge B is taken out of the main body of the image forming apparatus A will be described. This operation is opposite to the operation during mounting of the cartridge B. First, as the amount of contact between the first protrusion 79*t*2 and the contact portion 9*c*1 decreases, the first protrusion 79*t*2 receives the urging force by the urging member, which is not illustrated, and as the fixing shutter 9*c* is rotated in the direction indicated by the arrow N, which is opposite to the direction indicated by the arrow N, and gradually moves from the open position R to the closed position Q, the fixing shutter 9*c* is gradually closed.

As the cartridge is further taken out, the amount of contact between the second protrusion 79*t*3 and the contact portion 9*d*1 decreases, and the locking member 9*d* is rotated in a direction indicated by an arrow M' which is opposite to the direction indicated by the arrow M. As the cartridge is further taken out, the amount of contact between the third protrusion 79*t* and the contact portion 200 (see FIG. 6B) of the main body decreases, and the drum shutter 79 receives the urging force by the urging member 80 and is rotated in the direction opposite to the direction indicated by the arrow K in FIGS. 3 and 7A and 7B, and thus is gradually closed. Accordingly, when the cartridge B is taken out of the main body of the image forming apparatus A, the drum shutter 79 is located at the drum protecting position U.

As described above, in the present exemplary embodiment, the fixing device 9 is disposed on the downstream side of the cartridge accommodating portion AS in the mounting direction S1. Further, the pressing portions (first protrusion 79*t*2 and second protrusion 79*t*3) which move the movable member of the main body of the image forming apparatus A, such as the fixing shutter 9*c* or the locking member 9*d*, are provided on the cartridge B. With this structure, the force transmission mechanism necessary for moving the movable member using the mounting force of the cartridge B may be provided instead of the force transmission mechanism (link mechanism) which is required to move the movable members using the opening/closing force of the opening/closing member of the related art. Examples of the force transmission mechanism necessary for moving the movable member using the mounting force of the cartridge B include the drum shutter 79, the fixing shutter 9*c*, and the locking member 9*d*. In general, in a state where the cartridge B is mounted on the main body of the image forming apparatus A, the drum shutter 79 is disposed at a position closer to the fixing shutter 9*c* and the locking member 9*d* than the opening/closing member is. Accordingly, the force transmission mechanism necessary for moving the movable member using the mounting force of the cartridge B can be downsized as compared with the force transmission mechanism required to move the movable member using the opening/closing force of the opening/closing member of the related art. Consequently, a reduction in the size and cost of the image forming apparatus can be achieved. In addition, the drum shutter 79 serving as the movable member of the cartridge B is provided with the first protrusion 79*t*2, the second protrusion 79*t*3, and the third protrusion 79*t*. When the drum shutter 79 is located at the protecting position U, the first protrusion 79*t*2 and the second protrusion 79*t*3 are disposed on the inside of the outer shape G as viewed along the axial direction of the photosensitive drum. However, the third protrusion 79*t* of the drum shutter 79 receives a force during mounting of the cartridge B, so that the drum shutter 79 is pivotable at the drum exposure position W and movable to the outside of the outer shape G.

The movable member (drum shutter 79) whose position changes while moving to the frames (cleaning frame 71 and development frame) of the cartridge B is provided with the pressing portions (first protrusion 79*t*2 and second protrusion 79*t*3). In addition, when the cartridge B is mounted, the drum shutter 79 is located at the exposure position W, and the first protrusion 79*t*2 and the second protrusion 79*t*3 are disposed on the outside of the outer shape G. In particular, when the drum shutter 79 is located at the exposure position W, the first protrusion 79*t*2 and the second protrusion 79*t*3 are located at positions on the downstream side of the outer shape G or the frame of the cartridge B in the mounting direction S1 (or in the direction in which the cleaning frame 71 and the development frame are arranged). Therefore, in the mounting direction S1, it is possible to make a contact with the movable member, such as the fixing shutter 9*c* or the locking member 9*d*, which is disposed on the downstream side of the accommodating portion for the cartridge B in the main body of the image forming apparatus A. On the other hand, in a state where the cartridge B is taken out of the main body of the image forming apparatus A, the drum shutter 79 is located at the protecting position U and the first protrusion 79*t*2 and the second protrusion 79*t*3 are located on the inside of the outer shape G. Accordingly, the outer shape of the cartridge B is not larger than that when the first protrusion 79*t*2 and the second protrusion 79*t*3 are not provided, and thus an increase in the size of the cartridge B can be suppressed.

Thus, according to the present exemplary embodiment, the mechanism for moving the movable member of the main body of the image forming apparatus A can be downsized or eliminated. This leads to a reduction in the number of components, the size, and cost of the main body of the image forming apparatus A. On the other hand, the cartridge B is provided with a first operating portion that acts on the main body of the image forming apparatus A. The first operating portion is accommodated in the outer shape of a container located on the outside of the main body of the image forming apparatus, thereby suppressing an increase in the size of the cartridge.

Furthermore, the cartridge B is provided with a second operating portion that acts on the main body of the image forming apparatus A, and the main body of the image forming apparatus is provided with the locking member 9*d*. The second operating portion acts on the locking member 9*d* during mounting of the cartridge B and the locking member 9*d* releases the regulation of the movement of the fixing shutter 9*c*, and then the first operating portion moves the fixing shutter 9*c*. Accordingly, the possibility that the user may contact the heat source, such as the heating roller 9*a*, when the cartridge B is not mounted, is reduced, which leads to an improvement in safety.

In the present exemplary embodiment, the first protrusion 79*t*2 and the second protrusion 79*t*3 are disposed at one end of the drum shutter 79 in the axial line direction of the photosensitive drum 62. However, for example, the first protrusion 79*t*2 may be disposed at one end of the drum shutter 79 and the second protrusion 79*t*3 may be disposed at the other end of the drum shutter 79.

Furthermore, the first protrusion 79*t*2 is used for pressing in the opening/closing operation of the fixing shutter 9*c*. However, the member to be moved by the first protrusion 79*t*2 provided on the drum shutter 79 is not limited to the fixing shutter 9*c*. For example, the first protrusion 79*t*2 may be used for pressing to cause a laser shutter provided on the exposure device 3 to move between a position where the laser beam L is blocked and a position where the laser beam L is not blocked.

While aspects of the present disclosure has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-230514, filed Nov. 30, 2017, which is hereby incorporated by reference herein in its entirety.

What is claimed is:

1. A cartridge detachably mountable to a main body of an image forming apparatus, the main body including: a fixing portion that includes a heating rotation member and that heat-fixes a toner image on a sheet; and a mounting portion on which the cartridge is mounted, the fixing portion including a fixing shutter configured to be movable between a first position where a part of the heating rotation member is covered and a second position where the part of the heating rotation member is exposed, the fixing shutter including a force receiving portion configured to receive a force for causing the fixing shutter to move from the first position to the second position, the cartridge comprising:

a photosensitive member;

a frame configured to support the photosensitive member so that the photosensitive member is rotatable;

a photosensitive member shutter connected to the frame so as to be movable between a covering position where a part of the photosensitive member is covered and an exposure position where the part of the photosensitive member is exposed; and a pressing portion configured to press the force receiving portion of the fixing shutter while the cartridge is being mounted on the mounting portion to move the fixing shutter from the first position to the second position, the pressing portion being provided in the photosensitive member shutter.

2. The cartridge according to claim 1, wherein in a case where the photosensitive member shutter is located at the exposure position, the pressing portion is disposed on a downstream side of the frame in a mounting direction in which the cartridge is mounted on the mounting portion.

3. The cartridge according to claim 2, wherein the main body further includes a regulating member configured to be movable between a regulating position where a movement of the fixing shutter from the first position to the second position is regulated and a non-regulating position where the movement of the fixing shutter from the first position to the second position is not regulated, in a case where the force receiving portion is a first force receiving portion, the regulating member includes a second force receiving portion that receives a force for the regulating member to move from the regulating position to the non-regulating position, and in a case where the pressing portion is a first pressing portion, the photosensitive member shutter includes a second pressing portion that presses the second force receiving portion of the regulating member while the cartridge is being mounted on the mounting portion.

4. The cartridge according to claim 1, wherein in a case where the force receiving portion of the fixing shutter is a first force receiving portion, the cartridge includes a second force receiving portion configured to receive a force for causing the photosensitive member shutter to move from the covering position to the exposure position by contacting with a contact portion of the main body while the cartridge is being mounted on the mounting portion.

5. An image forming apparatus comprising:

a cartridge including a photosensitive member, a frame configured to support the photosensitive member so that the photosensitive member is rotatable, a photosensitive member shutter connected to the frame so as to be movable between a covering position where a part of the photosensitive member is covered and an exposure position where the part of the photosensitive member is exposed, and a pressing portion provided in the photosensitive member shutter; and a main body including a fixing portion that includes a heating rotation member and that heat-fixes a toner image on a sheet, and a mounting portion on which the cartridge is detachably mounted, the fixing portion including a fixing shutter configured to be movable between a first position where a part of the heating rotation member is covered and a second position where the part of the heating rotation member is exposed, the fixing shutter including a force receiving portion configured to receive a force for causing the fixing shutter to move from the first position to the second position, wherein while the cartridge is being mounted on the mounting portion, the pressing portion of the cartridge presses the force receiving portion of the fixing shutter to move the fixing shutter from the first position to the second position.

6. The image forming apparatus according to claim 5, wherein in a case where the photosensitive member shutter is located at the exposure position, the pressing portion is disposed on a downstream side of the frame in a mounting direction in which the cartridge is mounted on the mounting portion.

7. The image forming apparatus according to claim 6, wherein in a case where the force receiving portion is a first force receiving portion, the main body includes a regulating member configured to be movable between a regulating position where a movement of the fixing shutter from the first position to the second position is regulated and a non-regulating position where the movement of the fixing shutter from the first position to the second position is not regulated, the regulating member including a second force receiving portion configured to receive a force for the regulating member to move from the regulating position to the non-regulating position, and in a case where the pressing portion is a first pressing portion, the photosensitive member shutter includes a second pressing portion configured to press the second force receiving portion of the regulating member to move the regulating member from the regulating position to the non-regulating position while the cartridge is being mounted on the mounting portion.

8. The image forming apparatus according to claim 5, wherein in a case where the force receiving portion of the fixing shutter is a first force receiving portion, the cartridge includes a second force receiving portion configured to receive a force for causing the photosensitive member shutter to move from the covering position to the exposure position, and wherein the main body includes a contact portion configured to contact with the second force receiving portion of the cartridge for applying the force to the second force receiving portion while the cartridge is being mounted on the mounting portion, so that the photosensitive member shutter is moved from the covering position to the exposure position.

* * * * *